United States Patent [19]

Leach

[11] Patent Number: 4,861,109

[45] Date of Patent: Aug. 29, 1989

[54] BODY RESTRAINT DEVICE

[75] Inventor: Jamie S. Leach, Ada, Okla.

[73] Assignee: C. J. Leacho, Inc., Ada, Okla.

[21] Appl. No.: 248,625

[22] Filed: Sep. 26, 1988

Related U.S. Application Data

[63] Continuation-in-part of Ser. No. 233,420, Aug. 18, 1988.

[51] Int. Cl.[4] ..... A47D 15/00

[52] U.S. Cl. ..... 297/467; 297/485

[58] Field of Search ..... 247/485, 487, 467

[56] References Cited

U.S. PATENT DOCUMENTS

| | | | |
|---|---|---|---|
| 1,376,625 | 5/1921 | Johnston | 297/467 |
| 2,404,108 | 7/1946 | Stauffacher et al. | 227/49 |
| 2,451,007 | 10/1948 | White | 297/467 |
| 2,652,183 | 9/1953 | Hlivka | 297/467 X |
| 2,741,412 | 4/1956 | Hinkle | 297/467 |
| 3,239,271 | 3/1966 | Burgersen | 297/430 X |
| 3,604,750 | 9/1971 | Doering | 297/467 |
| 3,713,692 | 1/1973 | McCracken et al. | 297/467 |
| 4,037,764 | 7/1977 | Almosnino et al. | 224/6 |
| 4,050,737 | 9/1977 | Jordan . | |
| 4,235,474 | 11/1980 | Rosenberg | 297/465 |
| 4,428,514 | 1/1984 | Elf | 297/467 |
| 4,676,554 | 6/1987 | Harlick et al. | 297/467 |

*Primary Examiner*—Francis K. Zugel

*Attorney, Agent, or Firm*—Laney, Dougherty, Hessin & Beavers

[57] ABSTRACT

A body restraint device for restraining the body of a person from sliding from an upright sitting position to a slumping position or a position out of the chair or seat upon which it is desired to retain the body of the person. The body restraint device is of generally T-shaped configuration and includes a crotch portion which is joined to the center of an elongated waistband portion. The waistband portion includes a pair of opposed waistband wings which carry interlocking loop and hook portions of an interlocking fastening material. The part of the crotch portion which is most distally located with respect to the waistband carries a plurality of slots which are adapted to receive therethrough the waistband wings to permit the restraint device to be wrapped around the abdomen and hips of the person whose body is to be restrained.

8 Claims, 1 Drawing Sheet

BODY RESTRAINT DEVICE

RELATED APPLICATIONS

This application is a continuation-in-part of my copending U.S. patent application Ser. No. 233,420 entitled BODY RESTRAINT DEVICE, which application was filed in the U.S. Patent and Trademark Office On Aug. 18, 1988.

FIELD OF THE INVENTION

This invention relates to devices which can be used to comfortably encircle and restrain the body of an infant, or an older person who is physically infirm, against a propensity to slide downwardly to a slumping position or to slide entirely out of a chair or seat. More particularly, the invention relates to a body restraint device of the type which operates by extending around the abdomen of a person whose body is to be restrained in a sitting position, and concurrently extends around a portion of the structure upon which the person is seated.

BACKGROUND OF THE INVENTION

Brief Description of the Prior Art

Many restraining devices have previously been contrived for keeping infants seated upright in a high chair or other seat. The propensity of infants to wiggle in their chairs and slide down until they fall out of the chair is well known. A restraining device capable of preventing such sliding out of the chair will, of course, generally be required to have a portion of the restraint device extended through the crotch of the infant and around the waist.

Many devices have undertaken to safely and inexpensively achieve the objective of preventing the infant from sliding out of the high chair or other seat. Thus, for example, in U.S. Pat. No. 4,235,474, a harness for retaining a baby in a chair is illustrated. This harness has a body section which includes a crotch portion which extends around the buttocks of the baby and up across the abdomen. At a location near the upper end of the crotch portion where the crotch portion crosses the abdomen, the restraint device includes a pair of straps or wing portions which can be extended around the rear side of the seat and there tied together to lock the restraint device to the seat or chair, thereby preventing the infant from sliding out of the chair. The harness shown in this patent further includes a pocket which extends upwardly from the restraint device along the back of the infant, and is dimensioned to fit over the upper portion of the back of the chair. This type of harness allegedly does not restrain or impair the movement of the child's arms and legs, and the back of the infant is supported by the portion of the harness which extends from the crotch portion upwardly to the pocket which is slipped over the top of the chair.

A support harness is also illustrated and described in U.S. Pat. No. 4,050,737. In this support harness, a pair of shoulder straps are provided which extend over the infant's shoulders and are secured by Velcro straps to a tongue which projects upwardly along the back of the infant from a crotch portion which is centrally located in the fabric panel of which the harness is formed. The crotch portion carries a pair of opposed wings which include belts which can be extended around the back of the chair to secure the support harness to the chair.

In U.S. Pat. No. 4,037,764, a child carrier is disclosed by which a child may be suspended from straps which can then be carried by a parent or placed over a supporting member located above the child's head. The child carrier device shown in this patent includes a large panel which includes a portion which extends upwardly across the buttocks of the child and is engaged by large flat wings which extend from an abdomen portion of the panel around the sides of the child and engage Velcro strips or other fastening elements on the rear side of the buttocks portion of the panel. There then extends upwardly from the abdomen portion of the child carrier, a pair of elongated straps which form large bights or loops located above the head of the child, by which the child can be carried when seated in the carrier.

In U.S. Pat. No. 4,676,554, an article for restraining and supporting persons in a chair is illustrated and described. The restraining article includes a heart-shaped seat portion which carries a pair of straps at two of its corners. These straps can be used to tie the seat portion to the rungs at the corner of the seat of a chair in which the device is to be used. A pair of elongated straps extend from the point of the heart-shape of the seat portion, and when the seat portion or crotch portion of this device is pulled upwardly across the genital area and to the location of the abdomen, these straps can then be extended around the sides of the body and around the rungs or back of the chair, and there tied or secured to afford the desired restraint of the body of a person sitting on the crotch portion of the article. In this device, the back of the infant or other person restrained is pulled against the rungs or structural members of the back of the chair, and thus the article is not comfortable to the person restrained.

Other devices which may be employed for restraining infants or others when they are seated in a chair are those devices which are shown in Stauffacher et al U.S. Pat. No. 2,404,108 and Johnston U.S. Pat. No. 1,376,625.

Brief Description of The Present Invention

The present invention is a body restraint device which, by reason of its unique construction, is inexpensive to manufacture, very easy to use and is characterized by an ability to be quickly and easily adjusted to permit it to be used to restrain, or encircle, the bodies of persons of varying size.

The body restraint device of the present invention is a generally T-shaped structure which is preferably made of a soft fabric, but which can also be made of a plastic or even a soft leather, particularly where the restraint device is to be used with larger persons of greater bodily strength, where such more mature persons have a physical or mental infirmity of some type which makes the use of the restraint desirable. The restraint, in its T-shaped configuration, includes an elongated waistband constituting the cross bar of the T, and a crotch portion which is joined to the waistband at the center of the waistband.

The crotch portion, in a preferred embodiment, is of generally hour glass or figure eight configuration and includes a proximal part which is immediately adjacent, and joined to, the waistband, and a distal part which is the part of the crotch portion which is spaced farthest from the waistband. The distal part of the crotch portion carries a plurality of spaced slots. At its opposite end, the waistband includes a pair of elongated waistband wings which are joined to each other at the center of the waistband, and which can be passed through the slots in the distal part of the crotch portion as the restraint device is secured in position around the body of a person to be restrained in a sitting position. Means is provided on the two waistband wings to permit them to be interlocked in an encircling status after they have been passed through the slots in the distal part of the crotch portion.

In one mode of usage of the body restraint device, the waistband wings are passed through the slot in the distal part of the crotch portion, and are then doubled back and circled around behind the back of the person restrained and behind the back of a chair in which the person is sitting. This mode of usage is generally used with infants or smaller children. With larger children, or even with small adults or more mature persons of small frames, a different mode of usage is employed in which the waistband wings are extended through the slots in the distal part of the crotch portion, and are then not doubled back upon themselves, but are rather extended on around a chair back to retain the body of the person in a seated position.

From the foregoing description, it will be perceived that an important object of the invention is to propose a body restraint structure which can be very economically constructed, being preferably of one part construction and susceptible to manufacture from a variety of materials.

Another object of the invention is to provide a body restraint structure which can be quickly and easily placed in operative position around the abdomen and lower body of a person to prevent slumping or pitching forward from an upright, seated position in a chair or the like.

A further object of the invention is to provide a body restraint device which is of a construction such that it can be quickly and easily adjusted, during its placement for body restraint, so as to accommodate widely varying sizes of individuals whose bodies are to be restrained by the use of the device.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
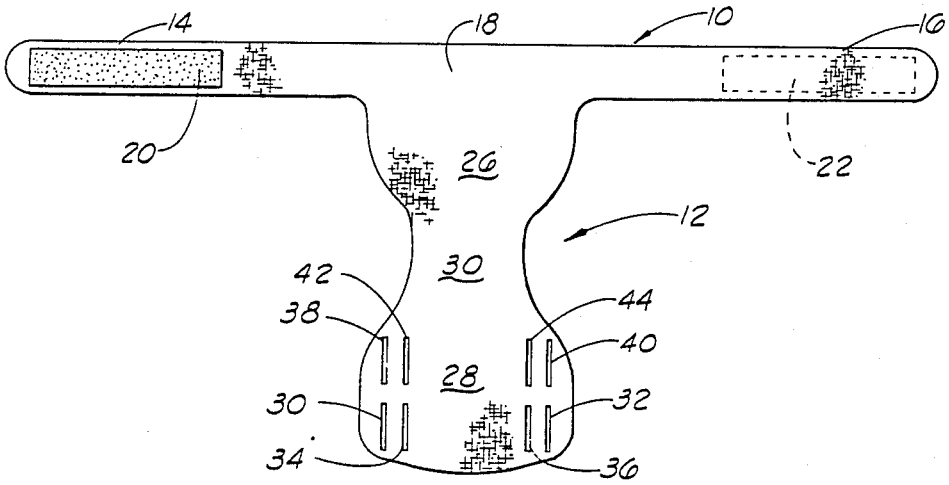
FIG. 1 is a view in elevation of the body restraint device of the invention. The device is shown in its flat substantially monoplanar status prior to use, and the side of the device which is visible is the inner side which is adjacent the body to be restrained when the device is in use.

The body restraint device of the invention includes an elongated waistband denominated generally by reference numeral 10. The waistband 10 is joined at its center to a crotch portion denominated generally by reference numeral 12. The crotch portion 12 and waistband 10 together impart a T-shaped configuration to the body restraint device, as will be clearly perceived in referring to FIG. 1. The restraint device has an inner side, shown in FIG. 1, which is the side which is adjacent the body of the person being restrained, and an outer side, which is the side visible in FIG. 2.

The waistband 10 includes a pair of elongated waistband wings 14 and 16 disposed at opposite ends of the waistband and joined to each other through a central section 18. The waistband wings 14 and 16 are rounded at their free ends. On one of the waistband wings 14, a rectangular pad or strip of locking material 20 is provided. The locking material 20 can conveniently be a strip of loop elements, such as Velcro. On the opposite waistband wing 16, and on the opposite side of the body restraint device from the side upon which the locking material 20 is located, a second fastening strip or band 22 is provided and provides complimentary fastening elements to those carried on the fastening strip 20. Thus, the fastening elements carried on the fastening strip 20 may be hooks which interengage with the loops on the fastening strip 22 when the two are pressed together. It will be noted that the rounding of the waistband wings 14 and 16 at their free ends facilitates the extension of these wings through slots formed in the crotch portion 12 at a location and for a purpose hereinafter described.

It will be noted in referring to FIG. 1 that the crotch portion 12 is generally of an hour glass shape or, described differently, is in a figure eight configuration. The crotch portion 12 includes a proximal part 26 which is joined to, and preferably formed integrally with, the central portion 18 of the waistband 10. The crotch portion 12 further includes a distal part 28 which is that part of the crotch portion which is farthest removed from the waistband 10. The distal part 28 of the crotch portion 12 lies on the opposite side of a central constricted or narrow section 31 of the crotch portion from the proximal part 26. The distal part 28 of the crotch portion 12 defines a plurality of slots. These slots may be perceived as including two sets of distal slots which include an outer slot pair 30 and 32, and an inner slot pair 34 and 36. There then are further included in the group of slots two pairs of proximal slots with these including an outer slot pair 38 and 40 and an inner slot pair 42 and 44. By reference to FIG. 2, it will be noted that the outer side of the crotch portion 12 carries a safety loop 46.

Figure 2:
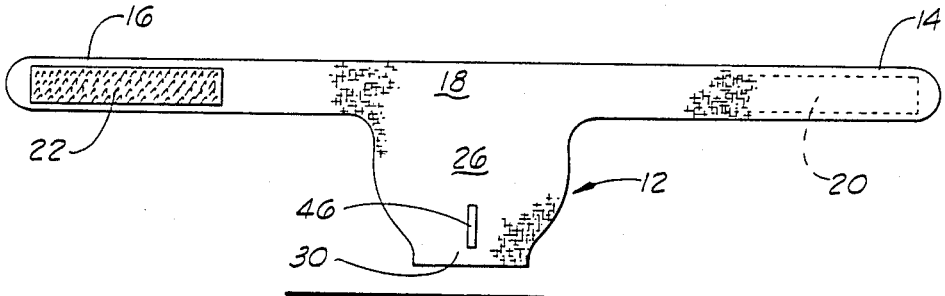
FIG. 2 is a view in elevation of the body restraint device of the invention, showing the first folding movement to which it is subjected as it is being placed in use. The outer side of the device is here shown.

When the body restraint device is to be used in one method of use, it is first placed upon a chair so that the crotch portion 12 rests flatly against the chair with the inner side, which is depicted in FIG. 1, facing upwardly, and the constricted or narrow, central section 31 located in the center of the seat of the chair. The person whose body is to be restrained, such as an infant or an infirm elderly person, is then seated on the chair with the legs spread apart so as to permit the crotch portion 12 of the restraint device to be folded upwardly around the abdomen and hips. This is accomplished by pulling the distal part 28 of the crotch portion 12 upwardly until its upper edge is approximately aligned with the navel of the person seated upon the body restraint device. The proximal part 28 is pulled upwardly to a corresponding level along the upper side of the hips, or along the lower back, of the seated person. At this time, the restraint device, if viewed from the rear side thereof, appears somewhat as shown in FIG. 2. Thus, the waistband wings 14 and 16 project laterally from opposite sides of the crotch portion 12 and may be gripped in order to then carry out the next step in the securement of the restraint device in its operating position.

In the next manipulation of the restraint device to place it in operation, the waistband wings 14 and 16 are grasped and the rounded free ends thereof are extended through a selected pair of the slots formed in the distal part 26 of the crotch portion. For purposes of illustration, in FIG. 4 of the drawings of this application, the waistband wings 14 and 16 have been shown as extended through the outer slot pair 30 and 32 of the distal slots. This is the particular arrangement and method of assembling used where a relatively large infant is to be confined by the body restraining device.

Figure 3:
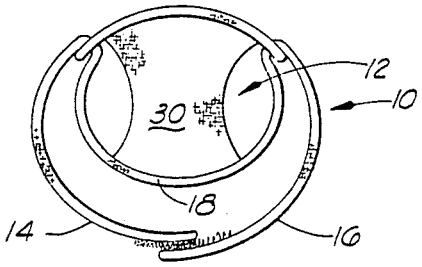
FIG. 3 is a top plan view of the body restraint device of the invention, showing its appearance when it is in operation, but not illustrating a person being restrained thereby, so as to afford greater clarity of illustration.

After the wings 14 and 16 have been extended through the slots 30 and 32 as described, the wings are reversely bent through an angle of almost 180°, as shown in FIG. 3, and are extended in a generally circular path so that the ends of the wings meet behind the back of the chair in which the person is to be confined or restrained in a sitting position. At this location, the fastening strips 20 and 22 are interengaged in the fashion well understood and conventional when using Velcro strips. Instead of the Velcro strips or fasteners 20 and 22, it is possible to use buckles, snaps or other suitable fastening devices.

Figure 4:
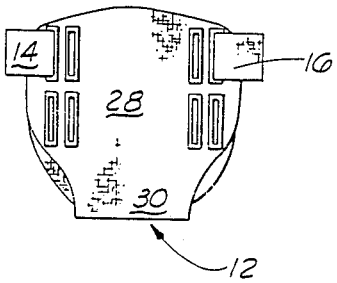
FIG. 4 is a front elevation view of the body restraint device when it is, in its operative position as shown in plan view in FIG. 3.
Figure 5:
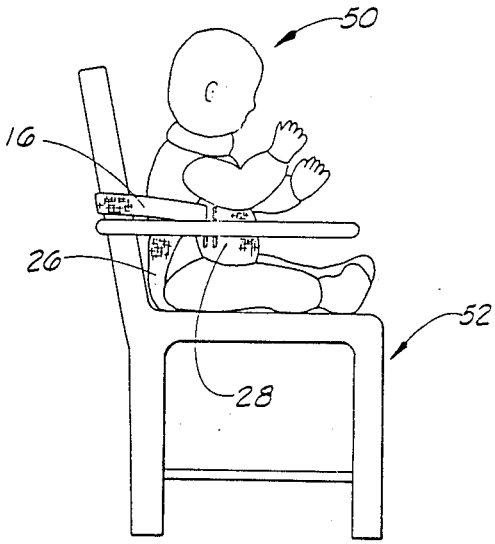
FIG. 5 is a side elevation view of an infant seated in a high chair, and having the body restraint device of the present invention in place and in use to restrain the infant in an upright seated position.

When the body restraint device of the invention has been assembled around the infant to restrain the infant in the upright seated position in the chair, the restraint device appears as shown in FIGS. 3, 4 and 5. In FIG. 5, an infant, denominated generally by reference numeral 50, is shown seated upon a chair 52 in an upright position. At this time, the body restraint device appears as shown in FIG. 3 from above in plan view. A front elevation view of the operatively positioned body restraint device is shown in FIG. 4.

From this description, it will be perceived that the body restraint device of the invention is simple of construction, and can be very quickly and easily placed in use by one having no special training, and possessing ordinary digital facilities, in terms of adequate manual dexterity to extend the free end portions of the waistband wings through the appropriate slots, and around behind the chair where the Velcro strips are interengaged to complete the securement and restraint. It will be noted in referring to FIGS. 3, 4 and 5 that the portions of the body restraint device which bear against the abdomen of the child, as well as against the small of the back and hips, are relatively broad, and the forces of constraint are distributed over a substantial area so as not to cut or feel uncomfortably binding in any localized area. The shape of the constraint device is such that it is possible to pin or place a diaper on the inner side 30 of the restraint device and have the dipper function in its usual manner. The diaper can be relatively easily removed by simple release of the restraint device and folding down the front and back sides thereof.

The restraint device of the invention is quite versatile and universal in the sense of the variety of modes of its usage. When the waistband wings 14 and 16 are extended through the proximal slots 30 and 32 and particularly the inner slot pair 42 and 44 of the proximal slots, a relatively smaller infant can be closely and comfortably confined by the body restraint device. At this time, the upper portion of the distal part of the crotch portion of the device can be folded downwardly and inwardly to provide a relatively thick or double layer of fabric adjacent the waist of the infant just below the navel so as to provide a guard structure in the event of accidental urination.

Moving the ends of the waistband wings out to the outer slots in the proximal slot pairs slightly increases the size of infant who can be comfortably yet positively confined by the body restraint device.

Finally, it should be pointed out that for a relatively larger person, such as an infirm older adult, or an incontinent person of relatively small frame, the wing portions 14 and 16 of the body restraint device can be used in a different manner, in conjunction with a re-orientation of the attitude of the entire restraint device with respect to the body to be restrained. In this case, the body restraint device is reversed so that the distal part 28 of the crotch portion 12 is placed adjacent the buttocks and lower spine of the body of the person who is to be restrained, and the waistband wings 14 and 16 are then extended through the outer slot pair 30 and 32 of the distal slots. Then, instead of being doubled back, and passed around behind the back of the chair and interlocked in the manner hereinbefore described, the waistband wings 14 and 16 are extended straight ahead for their entire length to reach around the relatively large body of the person to be restrained and the chair in which that person is seated. The wings 14 and 16 are then interlocked behind the back of the chair to provide the necessary restraint.

From the foregoing description of the invention, it will be perceived that the body restraint device provides a versatile, inexpensive and easily used device which can be employed to prevent the mispositioning of the body of a person who is to remain seated in an upright position due to that person tending to slide down in their chair, or to fall out of the chair by leaning forward too far.

Although a preferred embodiment has been herein described, it will be understood that various changes and innovations in the described structure can be made without departure from the basic principles of the invention. Changes and innovations of this type are therefore deemed to be circumscribed by the spirit and scope of the invention except as the same may be necessarily limited by the appended claims or reasonable equivalents thereof.

What is claimed is:

1. A body restraint device comprising:

an elongated waistband having a pair of opposed, elongated waistband wings joined to each other through a lower back-supporting central portion and being aligned with each other along aligned longitudinal axes of the elongated wings;

a crotch portion joined to said waistband at said central portion and extending therefrom in a direction generally normal to said aligned longitudinal axes of said elongated waistband wings to impart a T-shaped overall configuration to said body restraint device, said crotch portion having:

a proximal part immediately adjacent said waistband;

a distal part having spaced slots therethrough, with said slots being spaced from each other along a line substantially parallel to the aligned longitudinal axes of said elongated waistband wings; and a narrow central part joining said distal portion to said proximal portion, with said narrow central part having a lesser dimension along the line measured substantially parallel to the aligned longitudinal axes of said elongated waistband wings than the dimension of said proximal part and also the dimension of said part as said dimensions are measured along lines extending parallel to the aligned longitudinal axes of said elongated waistband wings; and cooperating fastening elements carried on the free ends of said elongated waistband wings, each of said elongated waistband wings having a length such that the respective wing can be extended through one of said slots and then be reverse bent through 180° back upon itself and extended around behind the central portion of said waistband to a location where the fastening element carried on the free end of the respective waistband wing meets the fastening element carried on the free end of the other of the waistband wings after the other of said waistband wings has been extended through the other of said slots, bent through 180° and doubled back upon itself and extended to the location where its fastening element is able to engage and cooperate with the fastening element on said one elongated waistband wing at a location behind the central portion of said waistband.

2. A body restraint device as defined in claim 1, wherein said crotch portion is hour-glass shaped in configuration.

3. A body restraint device as defined in claim 1 wherein said distal part of said crotch portion defines at least one pair of distal slots and at least one pair of proximal slots.

4. A body restraint device as defined in claim 1 wherein said waistband and said crotch portion are single, unitary piece of fabric material.

5. A body restraint device as defined in claim 1 wherein said cooperating fastening elements comprises:

a band of loops carried on one side of one of said waistband wings; and a band of hooks carried on the other of said waistband wings in a position such that said hooks will pass into and engage said loops.

6. A body restraint device as defined in claim 3 wherein said crotch portion is hour-glass shaped in configuration.

7. A body restraint device as defined in claim 6 wherein said waistband and said crotch portion are a single, unitary piece of fabric material.

8. A body restraint device as defined in claim 6 wherein said cooperating fastening elements comprises:

a band of loops carried on one side of one of said waistband wings; and a band of hooks on the other of said waistband wings in a position such that said hooks will pass into and engage said loops.

* * * * *

UNITED STATES PATENT AND TRADEMARK OFFICE

CERTIFICATE OF CORRECTION

PATENT NO. : 4,861,109

DATED : August 29, 1989

INVENTOR(S) : Jamie S. Leach

It is certified that error appears in the above-identified patent and that said Letters Patent is hereby corrected as shown below:

In the Specification:

In Column 5, line 62, delete "dipper" and insert -diaper-.

In the Claims:

In Column 7, line 9, after "said" insert -distal-.

In Column 8, line 9, after "are" insert -a-.

Signed and Sealed this

Twenty-second Day of May, 1990

*Attest:*

HARRY F. MANBECK, JR.

*Attesting Officer*

*Commissioner of Patents and Trademarks*